US006282452B1

(12) United States Patent
DeGuzman et al.

(10) Patent No.: US 6,282,452 B1
(45) Date of Patent: Aug. 28, 2001

(54) APPARATUS AND METHOD FOR WELL MANAGEMENT

(75) Inventors: Neil DeGuzman, Weston; Thomas W. McIntyre, Harvard, both of MA (US)

(73) Assignee: Intelligent Inspection Corporation, Somerville, MA (US)

( * ) Notice: Subject to any disclaimer, the term of this patent is extended or adjusted under 35 U.S.C. 154(b) by 0 days.

(21) Appl. No.: 09/195,879

(22) Filed: Nov. 19, 1998

(51) Int. Cl.[7] ..... G05B 13/02
(52) U.S. Cl. ..... 700/32; 700/90; 700/83
(58) Field of Search ..... 700/11, 32, 90, 700/83, 286; 702/6, 9, 11, 12, 19, 20, 31; 175/45, 40, 61, 24, 27; 166/250.01, 113, 64, 65.1; 340/853.2, 853.7, 853.5

(56) References Cited

U.S. PATENT DOCUMENTS 4,939,648 * 7/1990 O'Neill et al. ..... 702/6
5,237,539 * 8/1993 Selman ..... 367/69
5,706,896 * 1/1998 Tubel et al. ..... 166/313
5,947,213 * 9/1999 Angle et al. ..... 175/24
6,002,985 * 12/1999 Stephenson ..... 702/13
6,012,015 * 1/2000 Tubel ..... 702/6
6,109,367 * 8/2000 Bischel et al. ..... 175/24

* cited by examiner

*Primary Examiner*—William Grant
*Assistant Examiner*—Kidest Bahta
(74) *Attorney, Agent, or Firm*—George A. Herbster; Pearson & Pearson

(57) ABSTRACT

A control method and system for managing operations at a well. The well operation is divided into operating phases and a set of management requirements for each operating phase are established. An associate system for each discreet management requirement produces selected outputs based upon selected inputs from all the sensed dynamic variables as well as selected inputs from knowledge bases and models. Each associate displays real time functions depending upon the processing of any operating parameter, at the selected operating phase and discreet management requirement.

20 Claims, 8 Drawing Sheets

APPARATUS AND METHOD FOR WELL MANAGEMENT

BACKGROUND OF THE INVENTION

1. Field of the Invention

This invention relates generally to the management of a well and more specifically to a method and apparatus for facilitating the management of a well in the petroleum industry.

2. Description of Related Art

Companies invest significant amounts of capital in different types of wells for the production of raw materials, such as crude oil and natural gas. Over the years many technologies have been developed for specific aspects of oil well production. For example, advances in seismic techniques have improved results obtained during a predictability or exploration phase for determining the location of the existence of oil or gas reserves underground. Improvements in well drilling tools and respective control systems used during a construction and completion phase now provide sophisticated wells with multiple branches grouped into production zones. Preliminary refining and related controls and improvements in raw material transportation have improved the ability to process and transport product during a production phase. All of these improvements have been made to reduce the overall costs of producing petroleum by increasing the efficiencies of each of the foregoing and other phases that lead to the extraction of materials from the ground in either an aboveground or undersea environment.

Many of these improvements have resulted because sensors have been developed for measuring a number of dynamic parameters on a real-time basis. As these sensors have been developed over time, it has been possible for an experienced individual to review past history of different parameters and deduce various operational conditions and predict possible consequences. Now, however, the amount of data available is just too great for an individual to assimilate. Important changes in one parameter may go undetected by an individual even though that change may predict, in association with other parameters, some important event that could have severe adverse implications for a phase of the production cycle. For example, if an individual does not predict the grounding of a bit, the bit may be damaged when it grounds necessitating the removal of the bit and significant delays in a drilling schedule.

In an attempt to overcome problems introduced by the expansion of information available, many companies now divide each of the production cycle phases mentioned above into management requirements based upon different functional requirements of the phase. For example, the construction and completion phase has been divided into drilling, mud and geological functional aspects or specialties in which different personnel are responsible for assimilating the incoming data that is relevant to their respective specialties. This approach initially reduces the amount of data a single individual must assimilate. However, the approach still requires experienced personnel to evaluate the data. Moreover, as technology continues to develop, the number of parameters continues to increase. Consequently even a specialist will eventually receive more data than he or she can evaluate.

In prior art systems the data often undergoes some basic signal processing for display as a report in textual or graphic form. These systems, however, often present only historical data. They do not provide the data information in real time. Moreover, even if real time data was provided individual parameters in separate displays, an individual would have to assimilate the data. As a result, the validity of conclusions continue to be based upon the experience and skill of the specialist. Likewise any incorrect conclusion drawn by a specialist because certain conditions were overlooked can have a significant adverse impact on the production costs due to delays and damage.

SUMMARY

Therefore, it is an object of this invention to provide an apparatus and method for facilitating and improving the management of a well operation.

It is another object of this invention to provide an apparatus and method that enables individuals to cope with large amounts of information about a well in a meaningful manner.

It is still another object of this invention to provide an apparatus and method that enables individuals to cope with large amounts of information about a well in a meaningful manner in a real time basis.

In accordance with one aspect of this invention, the management of operations at a well is facilitated by sensing at least one dynamic parameter that characterizes the operation and by dividing the operations at the well into a plurality of operating phases as well as dividing management of the well operations into a plurality of discrete management requirements. During operations, an input is selected, processed and displayed as a real-time function depending upon the operating phase and the discrete management requirement.

BRIEF DESCRIPTION OF THE DRAWINGS

The appended claims particularly point out and distinctly claim the subject matter of this invention. The various objects, advantages and novel features of this invention will be more fully apparent from a reading of the following detailed description in conjunction with the accompanying drawings in which like reference numerals refer to like parts, and in which:

DESCRIPTION OF ILLUSTRATIVE EMBODIMENTS

Figure 1:
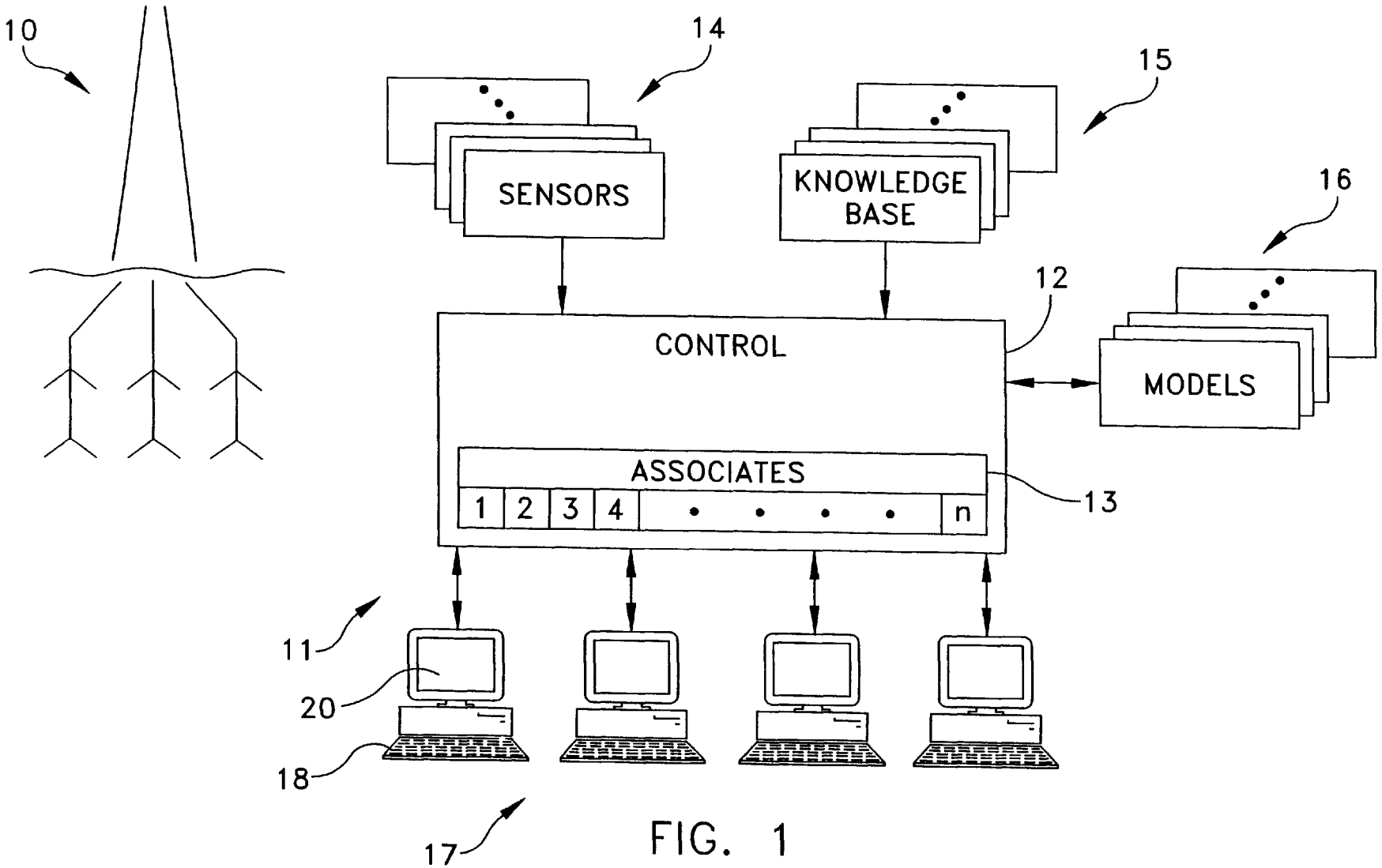
FIG. 1 is a block diagram of an apparatus constructed in accordance with this invention.

FIG. 1 generally depicts an oil well 10 as an example of a well to which this invention pertains. In accordance with this invention a control system 11 provides information to facilitate the management of the well. The heart of the control system is a control 12 with an associate system including individual associates 13(1) . . . 13(n). The actual number of associates in an associate system 13 will be dependent upon the nature of the specific functions over which the various phases of well development occur including the exploration, the construction-completion and the production or other phases for a well operation.

The control 12 receives a number of different inputs. Sensors 14 provide real time measurements of various dynamic parameters. Generally in the context of the well construction-completion phase, for example, these inputs may be related to time, drill bit location and velocity, rotational velocities of the drill bit, angles, measurements from various sensor devices, measurements concerning the geological characteristics at the drill bit and any of a number of other inputs.

Knowledge bases 15 provide information concerning different aspects of the well operation. For example, the knowledge bases 15 may include predicted characteristics of the materials along the projected well axis based upon previous seismic measurements. Knowledge bases may also include lists of operational constraints learned from the development of previous wells either in the immediate area or in similar geologic areas. Still other information could include knowledge regarding the performance capabilities of the current drilling equipment and knowledge of the particular crew on duty at any given moment including their individual skills and training levels.

Models 16 provide information such as a projected drilling pattern that relates time and drilling depth. Other models could include physical models of the drilling equipment dynamic behavior with varying amounts of drill string and mass distribution. Still other models could provide the hydraulic behavior of fluids as they are circulated through the drill pipe and the hole annulus.

The control 12 and particularly the individual associates 13(1) . . . 13(n) utilize information from the sensors 14, knowledge bases 15 and models 16 to produce outputs to various workstations 17 that will typically include keyboards 18 and visual displays 20. The displays 20 may also be interactive displays that can provide input information to the control 12 as a supplement to or in lieu of information provided by the keyboards 18 as described later.

Figure 2:
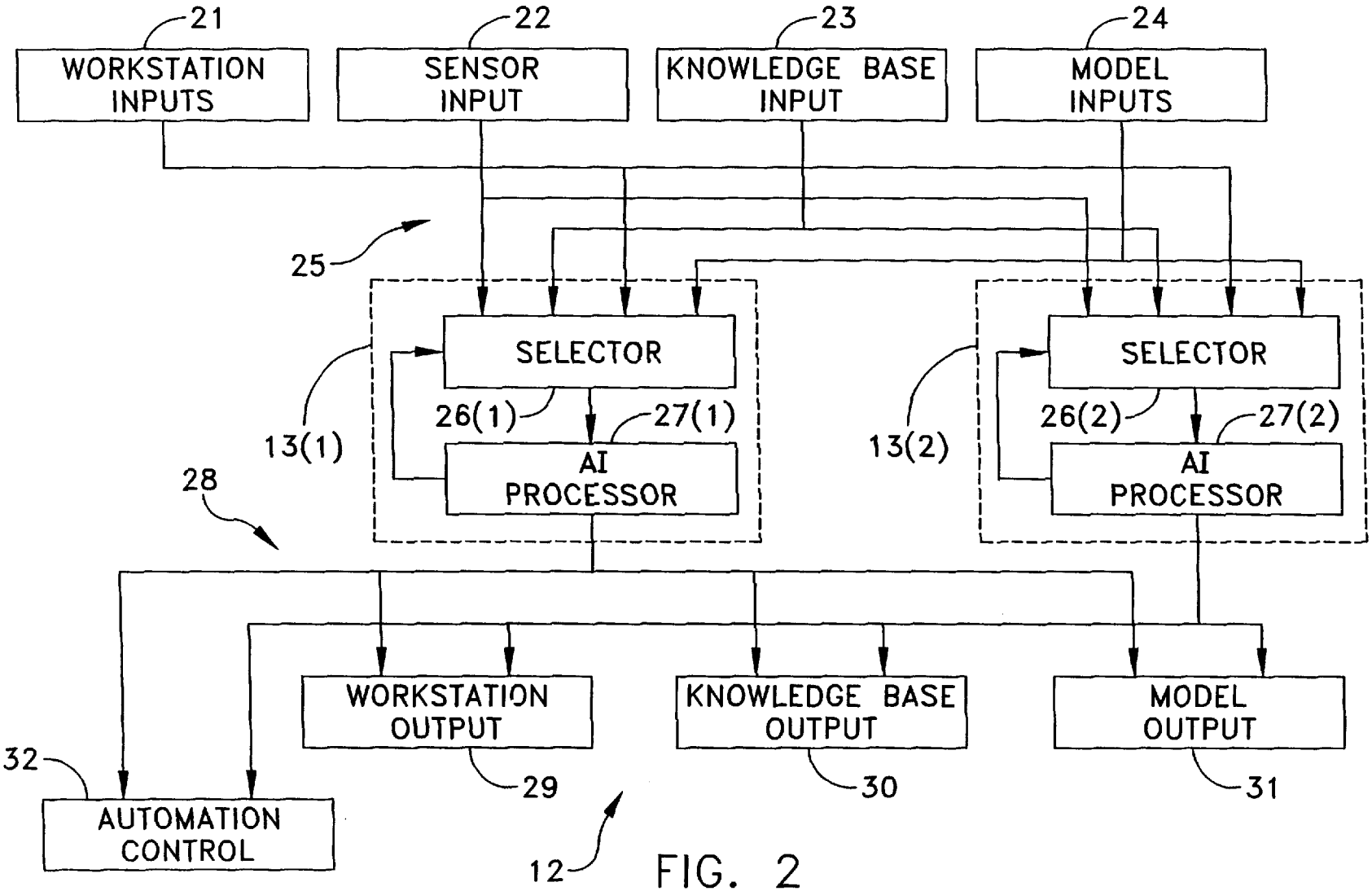
FIG. 2 is a block diagram of a portion of the apparatus shown in FIG. 1.

FIG. 2 depicts circuitry in the control 12 including two associates 13(1) and 13(2). This particular embodiment of the control 12 includes workstation inputs interface 21 for receiving input signals from the keyboard 18 or an interactive visual display device 20 as shown in FIG. 1. A sensor input interface 22, a knowledge base input interface 23 and a model input interface 24 are coupled to the sensors 14, knowledge bases 15 and models 16 respectively. Thus, the interfaces provide over a series of buses 25 access to all available information that is in the form of real time data from the sensor inputs 22 and in the form of historical or predicted data from the knowledge base and model interfaces 23 and 24.

Each of the associates 13(1) and 13(2) has a similar structure so only the associate 13(1) disclosed in detail. This associate includes a selector 26(1) and an AI processor 27(1). The AI processor 27(1) can be implemented with a number of different components or systems. Neural networks, fuzzy control systems and expert control systems are some examples of the types of systems that can be utilized to form the AI processor 27(1). Generally speaking, such AI processor will use behavior control concepts by which a control problem is decomposed into a number of task achieving behaviors all running in parallel. The AI processor 27(1) then provides an input signal to the selector 26(1) thereby to select the particular inputs available from the bus system 25 to be received in the AI processor 27(1) as a selected subset of sensed dynamic parameters relevant to the control problem.

Each of the AI processors, such as 27(1) and 27(2), attaches through a bus system 28 to a plurality of output interfaces including a work station output interface 29, a knowledge base output interface 30 and a model output interface 31. The workstation output interface 29 connects to the different visual displays 20 in the workstation 17 thereby to couple appropriate display data to each such workstation 17. The knowledge base output and model output interfaces 30 and 31 connect, respectively, to the knowledge bases 15 and model 16 thereby to provide a path by which the contents of the knowledge bases 15 and model 16 can be altered either by direct input from a keyboard 18 or as a consequence of actual measurements obtained from the sensors 14.

FIG. 2 additionally depicts an automation control 32 connected to the bus system 28 that could be utilized in connection with the system shown in FIG. 2. That is, the AI processors such as the AI processors 27(1) and 27(2) could produce, as an output thereof, an alarm condition or could monitor parameters to announce an alarm condition and convey sufficient information to the automation control 32 to provide an overriding control function. Alternatively the automation control 32 might take over certain functions that would otherwise be performed manually by personnel observing outputs from the workstation 17.

Figure 3:
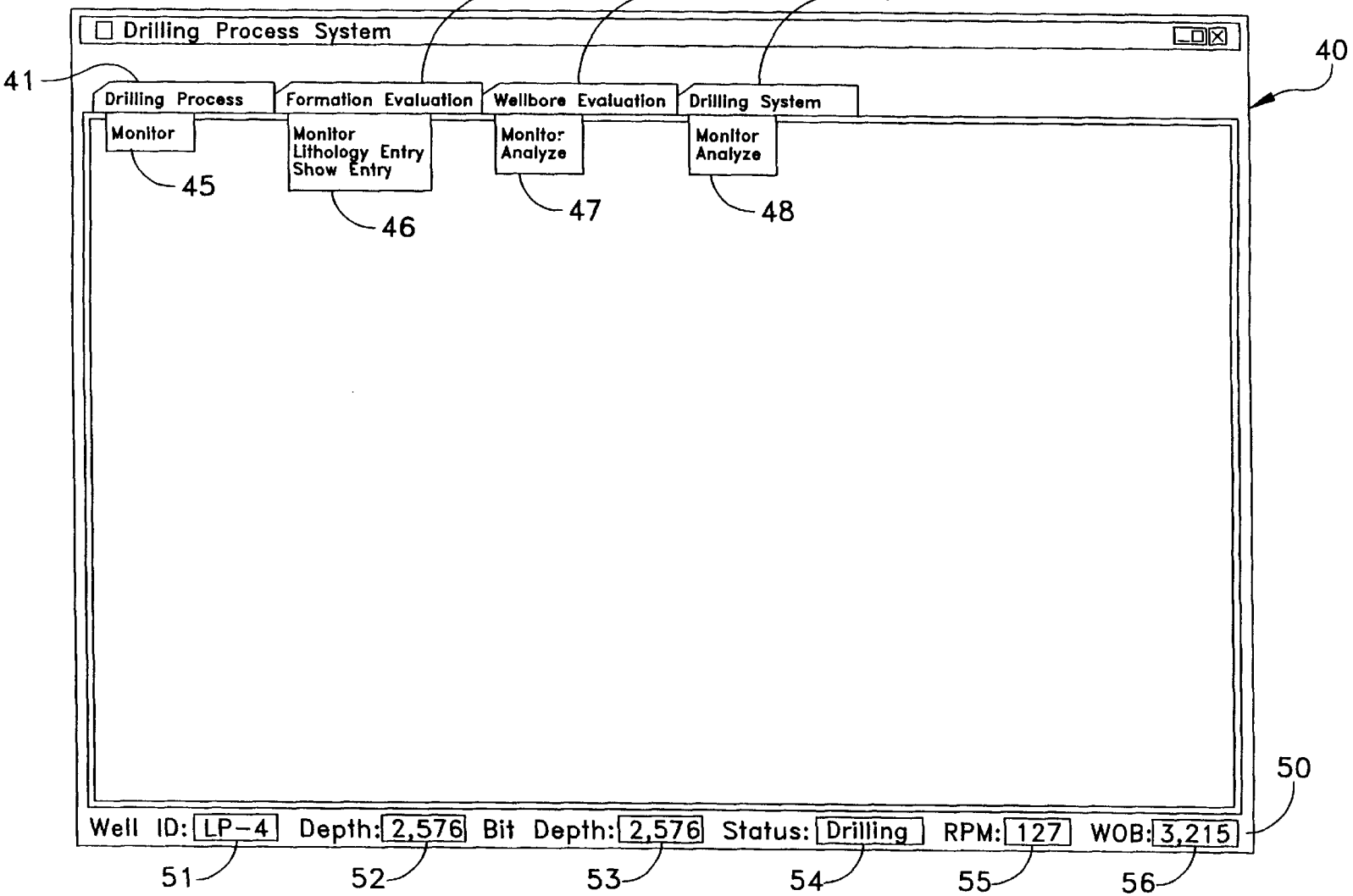
FIG. 3 is a basic display provided in accordance with this invention.

Although the foregoing sets forth a broad description of a control system constructed in accordance with this invention, a fuller understanding of the invention and its implications can be attained by referring to a specific example. In that vein, FIGS. 3 through 8 depict specific screens that are useful using associates 13 in FIG. 1 in drilling process, formation evaluation, wellbore evaluation and drill system management requirements that could occur during the construction and completion phase of a well. FIG. 3 depicts an example of a common or introduction screen 40 that displays a drilling process tab 41, a formation evaluation tab 42, a wellbore evaluation tab 43 and a drilling system tab 44. Each tab can have one or more options associated with it and those are shown as a drop down list 45 for the drilling process tab 41, a drop down list 46 for the formation evaluation tab 42, a drop down list 47 for the wellbore evaluation tab 43 and a drop down list 48 for the drilling system tab 44. Selection of any individual tab or option under the tab can then be accomplished by conventional means such a mouse click or shortcut key.

The display 40 also includes a status bar 50 for displaying real time values for selected dynamic variables and other information. For example, a window 51 defines the well being monitored. In an offshore platform the identification would be fixed. However, this invention is also applicable to be used in combination with various communication networks to allow remote reading of the information from the different associates. In such an application the number in the window 51 could be selected from a list. Window 52 and 53 depict the well depth and bit depth respectively, in FIG. 3 showing the bit at the bottom of the well. Status is displayed in window 54. In this case the drilling status is disclosed so that windows 55 and 56 have fixed numbers representing the rotational speed of the bit in window 55 and the weight on the bit (WOB) in window 56.

The contents of these windows are shown for example only and other parameters could be displayed according to particular requirements.

Tab 41 in FIG. 3 in this example produces a screen that displays certain outputs germane to the drilling process based upon the outputs from an associate, such as the associate 13(1) in FIG. 2. For this screen the selector 26(1) will route a number of subset inputs for parameters such as depth and location measurements for the drill bit, torque and speed measurements for the bit drive, measured formation information and other items on a real time basis into the AI processor 27(1). The selector 26(1) might also convey predetermined knowledge about the geological formation at the well obtained from previous seismic or other testing and a model projection such as a model of the expected drilling rate.

Figure 4:
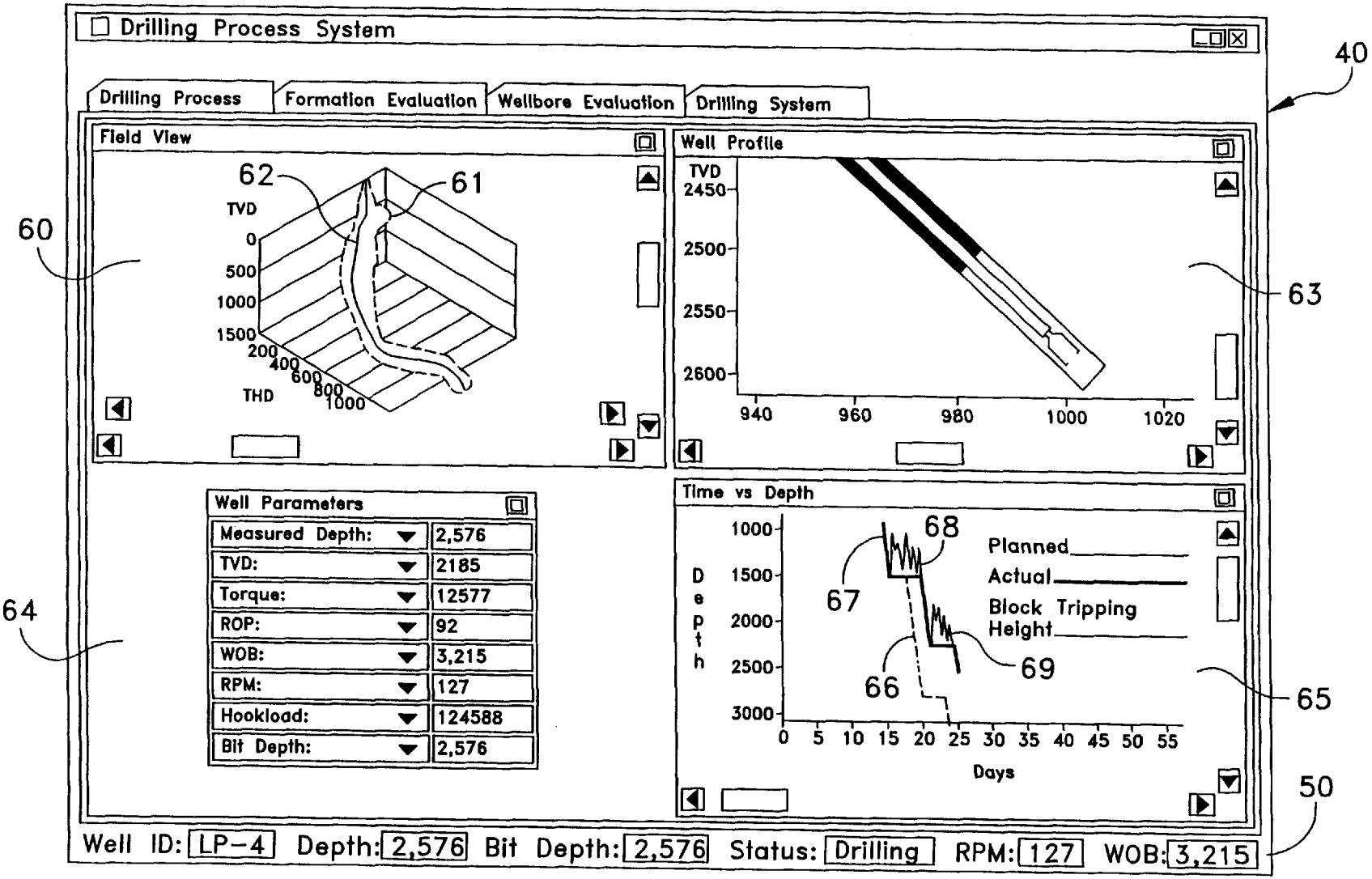
FIG. 4 is a view of a display associated with one management requirement during one operating phase.

The AI processor 27(1) then produces data to produce an output in graphical and textual form as shown in screen 40 in FIG. 4. This screen depicts four views including a field view 60 that is a three-dimensional view of the wellbore with indications of the types of materials provided by the formation knowledge base and shown as areas 61. This view, as other views in this an other screens, provides a real time analysis plus historical data concerning the position of the wellbore.

A well profile view 63 provides a plan view of the well and the position of the drill bit within the well. View 64 produces a list of important drilling process parameters that are updated in real time. View 65 provides an analysis of the drilling depth as a function of time. In this view the AI processor 27(1) projects a drilling schedule 66 from a model in the models 16 of FIG. 1. The graph 66 has horizontal plateaus that represent planned interruptions during the course of the drilling process for performing various tasks.

As the AI processor 27(1) receives various inputs from the sensor inputs, it produces a graph 67 that depicts the actual drilling. When the drilling reaches a plateau, the AI processor 27(1) selects another subset of signals from the sensor inputs that define the block height on the drilling well. this produces a trace 68 of the block height as a function of time. When drilling resumes the AI processor 27(1) stops generating that trace until another dwell time occurs as shown by trace 69 in FIG. 4. Thus in this case, the AI processor 27(1) uses several rules to determine what elements should be displayed. Moreover, as the drilling continues and the actual measurements show a deviation of the formation or other parameters from a model or knowledge base, the AI processor 27(1) can update the model or knowledge base data.

In the particular view of FIG. 4 it will be apparent that the basic data displayed in the status bar 50 remains at the bottom of the screen 40.

Figure 5:
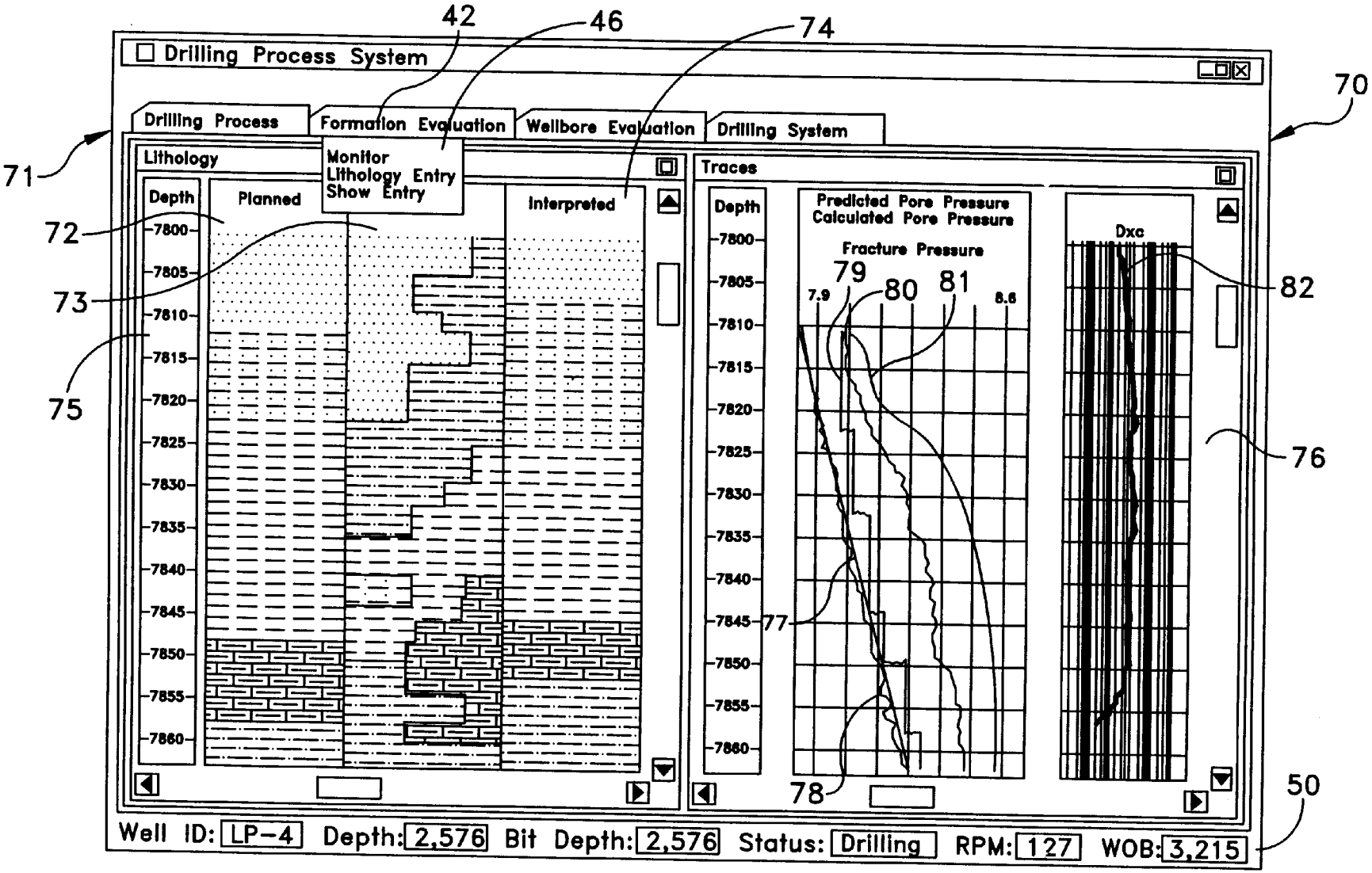
FIG. 5 is a view of a display associated with a second manage requirement during one operating phase.

If an expert for evaluating well lithology wishes to look at germane data, the formation evaluation tab 42 is selected along with a monitor subfunction that appears in the list 46 whereupon the screen 70 shown in FIG. 5 results along with the status bar 50. The formulation evaluation tab 42 and monitor function produce this display because the selector produces outputs from a wellbore evaluation associate. The display includes a lithology view 71 with a planned lithology display 72 a percentage lithology view 73 and an interpreted lithology view 74 all as a function of depth displayed at 75. Data displayed on the planned lithology view 72 is retrieved from a knowledge base 15, generally based on seismic or other data. The percentage view 73 is based upon actual measurements of various dynamic parameters as known in the art that determine the composition of the material at various depths. This shows that the material in the 7800 foot level is actually a mixture of two materials whereas the expectation was that only a single material would be found.

The formation evaluation associate for providing the screen 70 then may use this information to update the knowledge base 15. Alternatively this information could be modified into an interpreted value or equivalent value of a layer of material having a depth that functionally corresponds to the depth of the material actually obtained. This information can be correlated with additional knowledge held in models of the physical behavior of the hydrocarbon reservoir. This knowledge can either come from expert humans or a suitably constructed reservoir model and associated machine accessible knowledge base.

The view 76 includes a number of traces that display various values as a function of depth. In this particular view a line graph 77 depicts predicted pore pressure while graph 78 displays the readings of calculated pore pressure again based upon specific dynamic variables. Graph 79 depicts mud weight. As known it is always desirable to maintain the mud weight at a greater pressure than the calculated or actual pore pressure. Any excursion of actual pore pressure beyond mud weight can lead to an adverse result commonly known as a "kick".

The formation evaluation associate may also monitor the calculated pore pressure to determine rates of change and the difference between it and mud weight pressure in order to predict any adverse situation even before it occurs. That is, the associate could announce a problem requiring immediate attention. Fuzzy logic systems for example could be implemented to predict such an excursion.

Graph 80 depicts fracture pressure that is derived from rock mechanics models augmented with prior experience with the current drilling project and data from nearby wells. When needed or useful, this information can also be augmented by direct measurement of dynamic pressure changes following pressurization of the bore hose, i.e., a Leak-off Test.

Graph 81 depicts variations in over burden pressure that is derived from seismic information on the formation strata augmented by previous estimations using the physical properties of the rock strata including porosity, bulk density, and fluid permeability derived from down hole instrumentation such as nuclear, sonic or resistive property sensors.

Graph 82 depicts a parameter known as $D_{xc}$ that is a function of the rate of penetration of the drill bit and torque applied to the drill bit. Thus the signal is derived from actual measurements such as from sensors 14 in FIG. 1. Likewise the formation evaluation associate could monitor the values and rates of change of these signals to define a situation requiring immediate attention.

In either of the foregoing cases discussing requirements for immediate attention, the formation evaluation associate can also provide a display of related critical parameters and the history of those parameters in order to facilitate an analysis of a potential problem.

Figure 6:
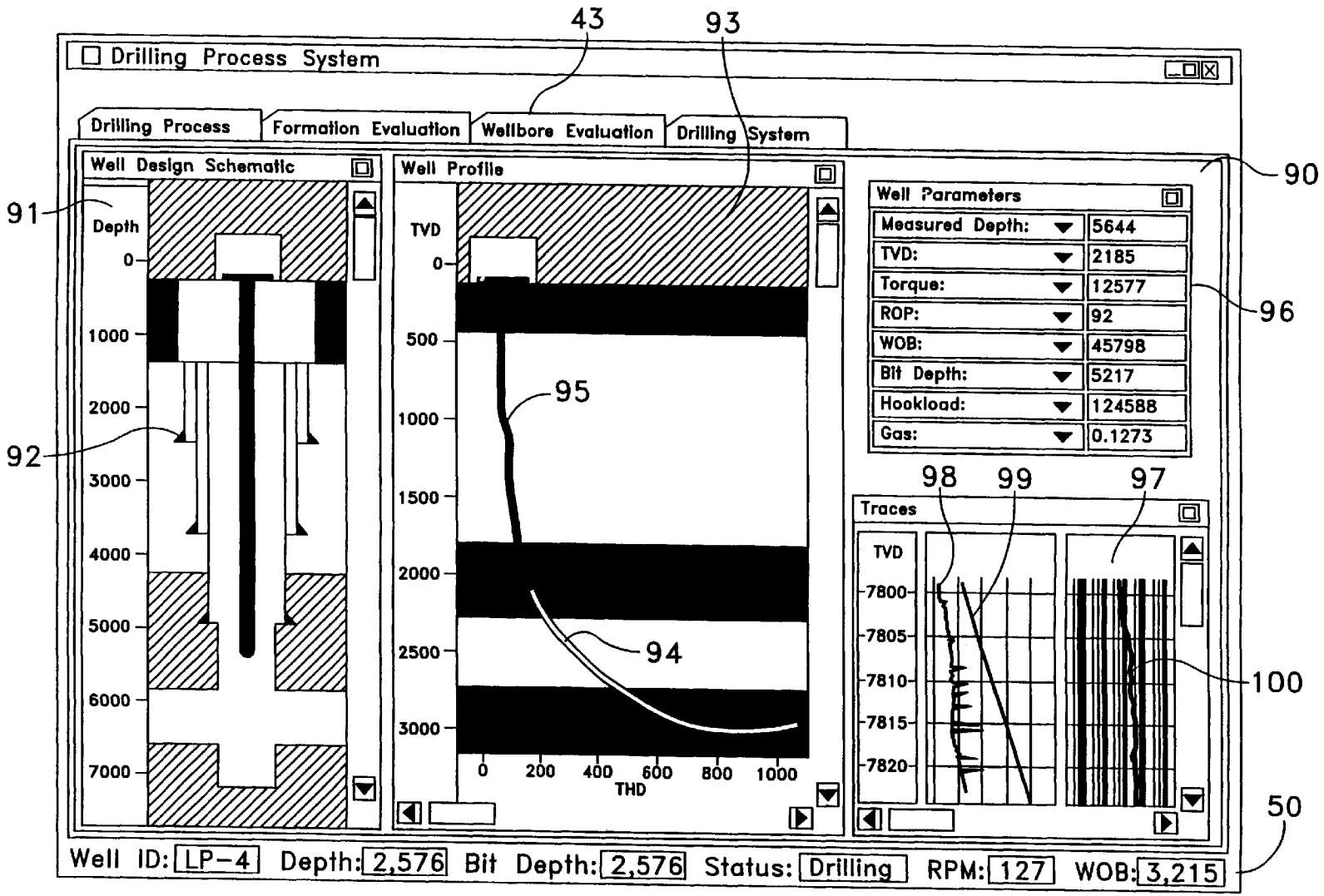
FIG. 6 is a view of a display associated with a third management requirement during one operating phase.

If a person depresses a tab 43 for wellbore evaluation a screen 90 as shown as FIG. 6 can be displayed by a corresponding wellbore evaluation associate. This screen 90, like the screens in FIGS. 4 and 5, has multiple views of particular aspects that are important to a wellbore evaluation. A well schematic 91 depicts the position of various casings within the wellbore including the location of casing points 92. A well profile view 93 can provide another view of the projected well path 94 and the actual well path 95. Well parameters are presented in a list display 96 on a real time basis. Another set of views 97 display surface torque in a graph 98 and a rate of penetration graph 99. These represent a display of a dynamic variables and the corresponding associate can further analyze the variables on a real time basis to detect any anomalies. Other parameters that could be displayed on other screens can also be displayed on a plurality of screens. In this particular view, for example, the $D_{xc}$ graph 100 corresponds to the $D_{xc}$ graph 82 in FIG. 5.

Figure 7:
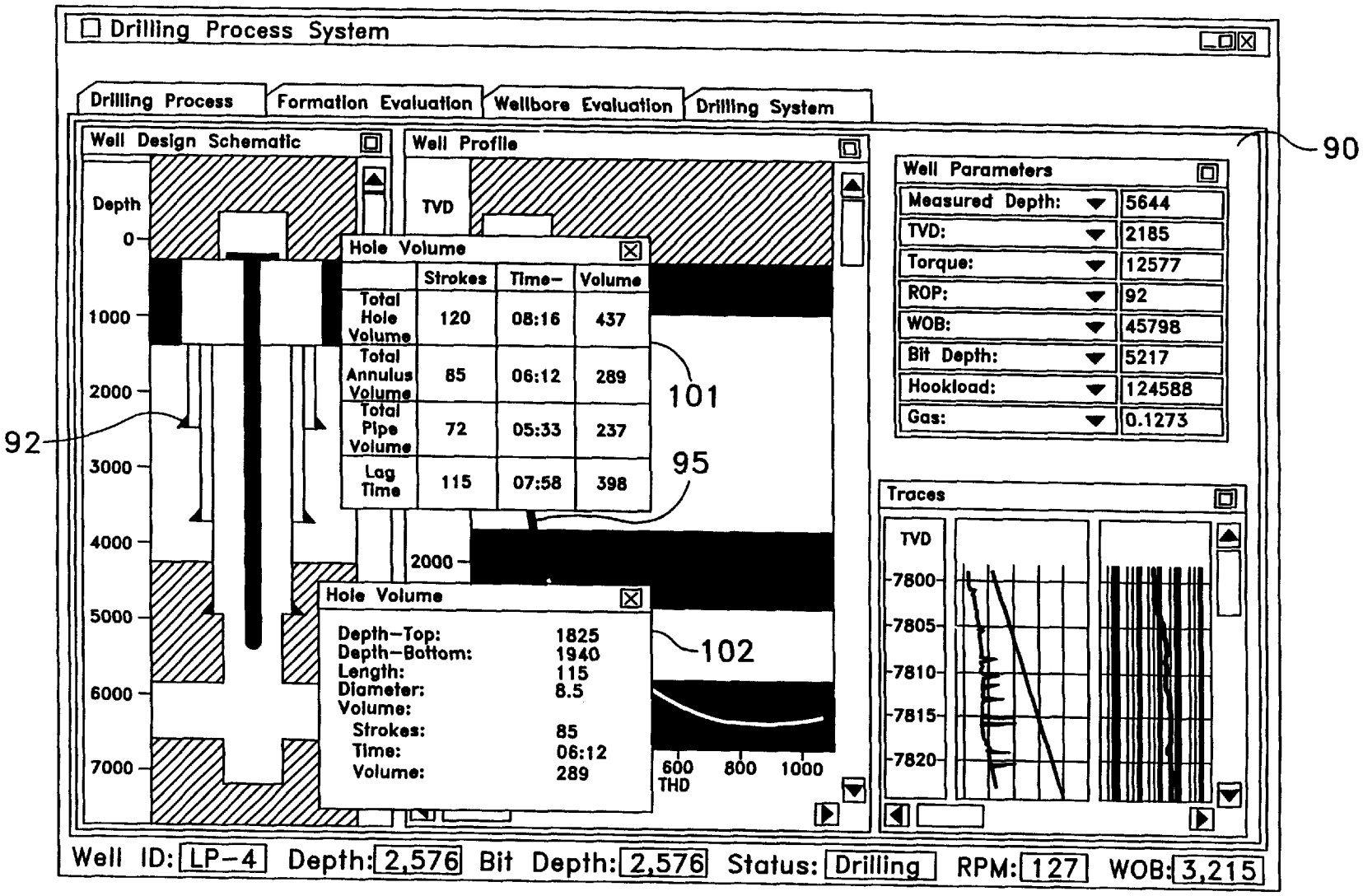
FIG. 7 is an alternate view of a display associated with the third management requirement during one operating phase.

Each associate can be further programmed to provide further detail for any particular point of graphically displayed information. FIG. 7, for example, shows the wellbore evaluation view 90 with a hole volume 101 and an annulus display 102. The data in the hole volume, which typically would be received from one of the knowledge bases 15, would be retrieved in response to clicking a mouse or otherwise selecting the actual drill path 95. The annulus 14 data box 102 would be selected by clicking on a particular casing point such as the casing point 92. Alternatively or in addition, clicking or otherwise selecting a point on an image could display other critical portions of either the casing, the open hole section or the riser section in the case of subsea drilling operations.

Figure 8:
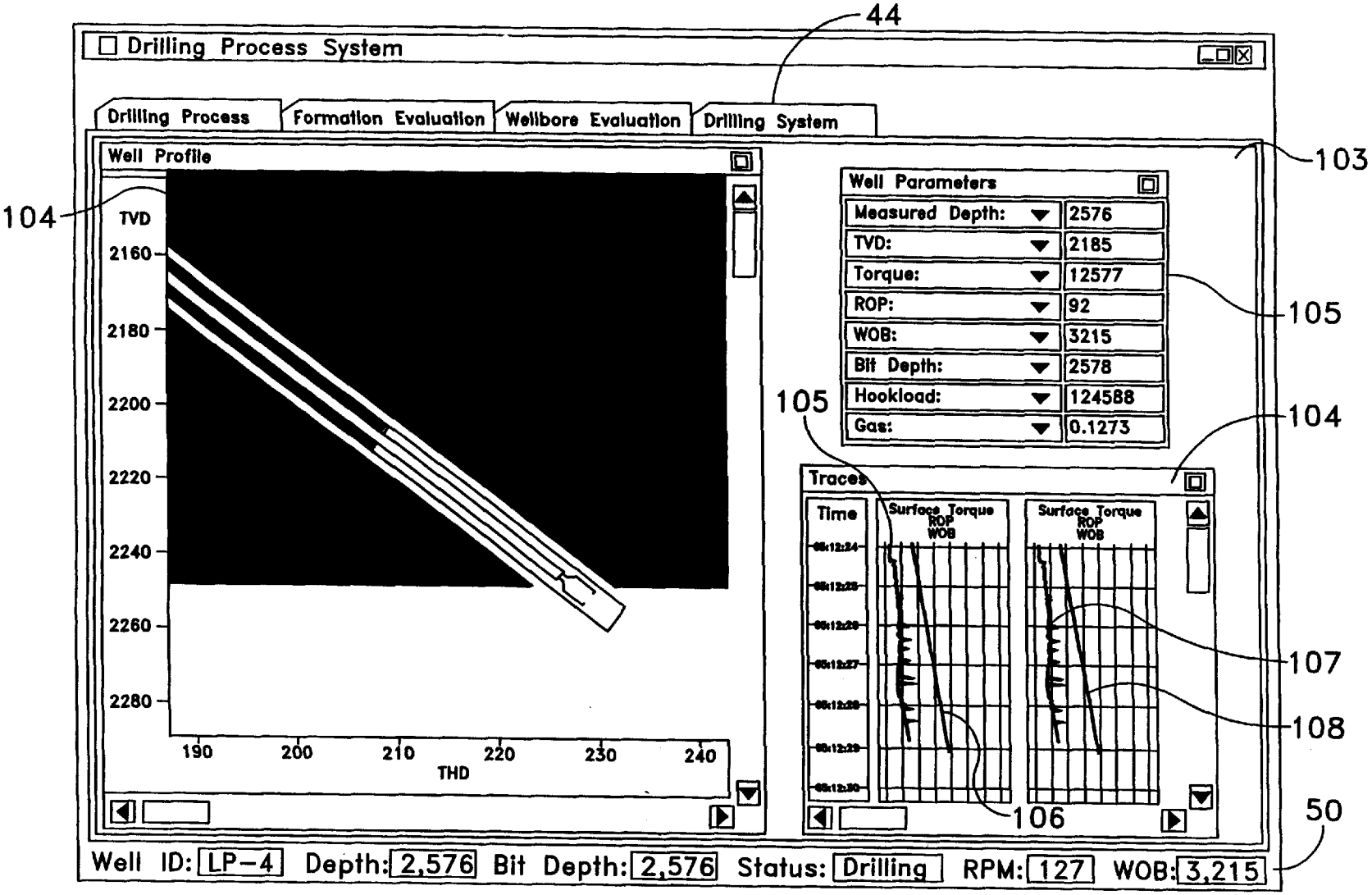
FIG. 8 is a view of a display associated with a fourth management requirement during one operating phase.

FIG. 8 depicts a screen 103 that a drilling system associate would display when tab 44 is selected. The screen 103 includes a well profile display that might be particularly appropriate for an overall system analysis where the details of the exact path of the wellbore is not so important, but measuring the progress of the drilling is. A list 105 could be displayed of various well parameters including some of the parameters displayed in the status bar 50 to provide that information in a user friendly form. Other traces could also be provided in a traces view 104 that includes a surface torque graph 105 and a rate of penetration graph 106. That view also includes a pump pressure graph 107 and a flow rate 108. This set of view will then give a well superintendent a good view of the overall operation at the wellbore, but in a slightly different format than is provided for anyone doing a wellbore evaluation or the more detailed drilling process operations.

Thus in essence the control system shown in FIG. 1 and a method utilizing the control system in FIG. 1 senses at least one dynamic parameter and typically a large a number of parameters involving drill bit location and other drill bit parameters, materials composition and related information. The operation at the well is then divided into a plurality of arbitrary operating phases. In this particular example we have disclosed a system in which the operating phases include an evaluation phase, a construction and completion phase and a production phase. Other divisions are also possible. Each phase is further characterized by one or more discreet management requirements. The construction and completion phase has been defined with drilling process, formation evaluation, wellbore evaluation and drilling system management requirements. An associate corresponding to each of the management requirements selects input data from the sensors, knowledge bases and models as required for that particular associate. Moreover, it has been shown the inputs can be varied even during the course of the operation of a particular associate. The associate processes the selected dynamic parameters and any other information it requires and displays a real time function that depends upon the processing of the selected parameters, the selected operating phase and the selected discreet management requirement. As will now be apparent, the same regimen can be utilized to provide similar control over other operating phases such as the evaluation phase and production phases. It will be apparent this system can also be provided so that data representing actual input parameters modify existing knowledge bases and models as deviations from those knowledge bases and models are noted. This can be done automatically or only with operator approval.

A wide variety of alternatives could be incorporated within this invention. The number of sensors and the contents of the knowledge bases and the models 16 in FIG. 1 can all be varied or in some cases combined to produce one set of inputs. The associates can be implemented in any number of ways using different existing technologies. The output workstations can have a number of different configurations and may be either local to the particular well being monitored or remote from that well. Moreover, a system can control multiple wells or monitor multiple wells. FIG. 2 depicts a particular implementation of a plurality of associates. It will be apparent to those of ordinary skill in the art that a number of variations to the particular configuration can be made and still obtain substantially the same results in substantially the same way as depicted in FIG. 2.

Thus this invention has been disclosed in terms of certain embodiments, even though many modifications can be made to the disclosed apparatus without departing from the invention. Therefore, it is the intent of the appended claims to cover all such variations and modifications as come within the true spirit and scope of this invention.

What is claimed as new and desired to be secured by Letters Patent of the United States is:

1. A control method for displaying data for managing operations at a well comprising the steps of:

A) sensing a plurality of dynamic parameters related to ongoing well operations;

B) dividing the operations at the well into a plurality of operating phases;

C) dividing management of the well operations into a plurality of discrete management requirements;

D) selecting a management requirement;

E) selecting a subset of the sensed dynamic parameters depending upon the operating phase at the well and the selected discrete management requirement;

F) processing the selected dynamic parameter subset to provide at least one real-time function of well operations; and G) displaying the processed at least one real-time function based upon the processing of the selected subset of sensed dynamic parameters relevant to the selected discrete management requirement.

2. A control method as recited in claim 1 additionally comprising the step of providing a knowledge base wherein said processing includes processing of the selected dynamic parameter and selected information from the knowledge base.

3. A control method as recited in claim 1 additionally comprising the step of providing a model for an operation wherein said processing includes processing of the selected dynamic parameter and selected information from the model.

4. A control method as recited in claim 1 additionally comprising the step of providing a model for an operation and a knowledge base wherein said processing includes processing of the selected dynamic parameter and selected information from the model and the knowledge base.

5. A control method as recited in claim 1 wherein said processing includes establishing a a separate process for each operating phase.

6. A control method as recited in claim 5 additionally including the step of providing a knowledge base and models and wherein said processing includes selecting a subset of inputs from the knowledge base and models.

7. A control method as recited in claim 6 wherein said processing includes artificial intelligence processing of the selected inputs and varying the selections for said processing.

8. A control method as recited in claim 6 additionally comprising the steps of varying the knowledge base and models in response to said processing.

9. A control method as recited in claim 1 additionally comprising the step of providing additional input information for said processing.

10. A control method as recited in claim 1 additionally comprising well control apparatus wherein said processing produces functions for controlling the well control apparatus.

11. Control apparatus for managing operations at a well comprising:

A) means for sensing a plurality of dynamic parameters related to well operations;

B) means for dividing the operations at the well into a plurality of operating phases;

C) means for dividing management of the well operations into a plurality of discrete management requirements;

D) selecting a management requirement;

E) means for selecting a subset of the sensed dynamic parameters depending upon the operating phase at the well and the selected discrete management requirement;

F) means for processing the selected dynamic parameter subset to provide at least one real-time function of well operation; and G) means for displaying the processed at least one real-time function based upon the processing of the selected subset of sensed dynamic parameters relevant to the specific operating phase and the selected discrete management requirement.

12. Control apparatus as recited in claim 11 additionally comprising knowledge base means for containing certain data wherein said processing means operates on the selected dynamic parameter and selected information from said knowledge base means.

13. Control apparatus as recited in claim 11 additionally comprising model means containing at least one operation model wherein said processing means operates on the selected dynamic parameter and selected information from the model.

14. Control apparatus as recited in claim 11 additionally comprising model means containing at least one operation model and knowledge base means for containing certain other data wherein said processing means operates on the selected dynamic parameter and selected information from said model means and said knowledge base means.

15. Control apparatus as recited in claim 11 wherein said processing means includes means for enabling a separate process for each operating phase.

16. Control apparatus as recited in claim 15 additionally including means containing a knowledge base and models and wherein said processing means includes means for selecting a subset of inputs from the knowledge base means and said model means.

17. Control apparatus as recited in claim 16 wherein said processing means includes artificial intelligence processing means for processing the selected inputs and varying the selections to said processing means.

18. Control apparatus as recited in claim 16 additionally comprising means for varying the said knowledge base means and said model means in response to said processing.

19. Control apparatus as recited in claim 11 additionally comprising means for providing additional input information for said processing means.

20. Control apparatus as recited in claim 11 additionally comprising well control apparatus wherein said processing means includes means for controlling the well control apparatus.

* * * * *